US008585175B2

(12) United States Patent
Hayashi

(10) Patent No.: US 8,585,175 B2
(45) Date of Patent: Nov. 19, 2013

(54) NOZZLE STATE DETECTING APPARATUS AND IMAGE FORMING APPARATUS

(75) Inventor: Toshihiro Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 13/399,908

(22) Filed: Feb. 17, 2012

(65) Prior Publication Data

US 2012/0212529 A1 Aug. 23, 2012

(30) Foreign Application Priority Data

Feb. 22, 2011 (JP) ..... 2011-035405

(51) Int. Cl.
*B41J 29/393* (2006.01)

(52) U.S. Cl.
USPC ..... 347/19; 347/14; 347/5

(58) Field of Classification Search
USPC ..... 347/5, 9, 12, 14, 19
See application file for complete search history.

(56) References Cited

U.S. PATENT DOCUMENTS 5,757,392 A * 5/1998 Zhang ..... 347/14
6,375,297 B1 4/2002 Hayashi et al.
7,600,847 B2 * 10/2009 Zhang ..... 347/19

FOREIGN PATENT DOCUMENTS

JP 3102429 B2 10/2000
JP 4389464 B2 12/2009

* cited by examiner

*Primary Examiner* — Lam S Nguyen
(74) *Attorney, Agent, or Firm* — Maschoff Brennan

(57) ABSTRACT

A plurality of transmission gates provided in mask circuits each having another transmission gate which connects/disconnects an original signal generating circuit to/from a corresponding piezoelectric element (electrode), and a plurality of voltage waveform detecting circuits respectively connected to the electrodes of the respective piezoelectric elements via the former transmission gates are provided exclusively for the respective piezoelectric elements. In detecting an ejection failure of each nozzle, the original signal generating circuit generates a test drive signal enough to prevent each nozzle from ejecting ink to switch all the latter transmission gates on for a certain time, and then switch them off, and switch all the former transmission gates on, so that an ejection failure of the corresponding nozzle is determined based on the vibration period of a voltage waveform detected by the voltage waveform detecting circuit for each piezoelectric element.

10 Claims, 5 Drawing Sheets

NOZZLE STATE DETECTING APPARATUS AND IMAGE FORMING APPARATUS

This application claims the benefit of Japanese Application No. 2011-035405, filed Feb. 22, 2011, all of which are hereby incorporated by reference.

BACKGROUND

1. Technical Field

The present invention relates to a nozzle state detecting apparatus that detects the states of a plurality of nozzles included in an ejecting head ejecting fluids from the nozzles by respectively driving a plurality of piezoelectric elements provided in the ejecting head and equal in number to the nozzles, and an image forming apparatus that ejects a fluid on a medium to form an image thereon.

2. Related Art

There has been proposed a nozzle state detecting apparatus of such a type that determines an ejection failure (dropped dots) of a nozzle by detecting residual vibration of a vibrating plate when an electrostatic actuator is driven in an ink jet printer including an ink jet head which causes the electrostatic actuator to vibrate the vibrating plate to contract the volume of a cavity (ink chamber), thereby ejecting ink droplets from the nozzle communicating with the cavity (see, for example, JP-A-2004-306529). When ink dries and, for example, adheres near a nozzle, causing an ejection failure, the frequency of the residual vibration becomes low as compared with the case of normal ejection. Accordingly, this detecting apparatus detects the period of residual vibration, and compares the detected period of residual vibration with the period of residual vibration in the case of normal ejection to thereby accurately detect an ejection failure of a nozzle.

SUMMARY

Properly detecting nozzle states by enhancing the precision of detecting nozzle states as described above, or detecting nozzle states in a short period of time is considered as one of important factors in an image forming apparatus to improve the quality of an image at the time of forming the image, or improving the throughput of image formation.

An advantage of some aspects of the invention is to provide a nozzle state detecting apparatus and an image forming apparatus that detect the states of nozzles more adequately.

The nozzle state detecting apparatus and image forming apparatus according to the advantage are achieved by employing the following configurations.

The nozzle state detecting apparatus according to an aspect of the invention detects states of a plurality of nozzles included in an ejecting head ejecting fluids from the nozzles by respectively driving a plurality of piezoelectric elements provided in the ejecting head and corresponding to the nozzles, and includes a voltage signal output unit that outputs a voltage signal for driving the piezoelectric elements, a plurality of first switches provided in association with the piezoelectric elements, and having input terminals connected to the voltage signal output unit and output terminals connected to electrodes of the respective piezoelectric elements to effect connection and disconnection between the input and output terminals, a plurality of second switches provided in association with the piezoelectric elements, and having input terminals connected to the electrodes of the respective piezoelectric elements to effect connection and disconnection between the input and output terminals, a plurality of voltage waveform detecting units provided in association with the piezoelectric elements and connected to the output terminals of the second switches to detect voltage waveforms of the respective piezoelectric elements via the second switches, and a nozzle state determining unit that, when detecting the states of the nozzles, controls the first switches and the second switches to set the first switches off and set the second switches on, and determines the states of the nozzles based on the respective voltage waveforms detected by the voltage waveform detecting units under the switch control.

The nozzle state detecting apparatus according to the aspect of the invention is provided with a voltage signal output unit that outputs a voltage signal for driving a plurality of piezoelectric elements, and provided with a plurality of first switches having input terminals connected to the voltage signal output unit and output terminals connected to the electrodes of the respective piezoelectric elements, a plurality of second switches having input terminals connected to the electrodes of the respective piezoelectric elements, and a plurality of voltage waveform detecting units that detect voltage waveforms of the respective piezoelectric elements via the second switches, in association with the piezoelectric elements. To detect nozzle states, the nozzle state detecting apparatus controls the first switches and the second switches to set the first switches off and set the second switches on, and determines the states of the nozzles based on the respective voltage waveforms detected by the voltage waveform detecting units under the switch control. Accordingly, the nozzle state detecting apparatus can detect the states of a plurality of nozzles simultaneously, making it possible to complete detection of the nozzle states quickly and take measures in response to the nozzle states accordingly. Since the dedicated second switch and the dedicated voltage waveform detecting unit are provided for each of the piezoelectric elements, heat generated in the operation can be suppressed as compared with the type that has a single second switch and a single voltage waveform detecting unit provided for a plurality of piezoelectric elements and detects the voltage waveforms of the piezoelectric elements while switching from one piezoelectric element to be driven to another. As a result, the states of the nozzles can be detected more adequately.

In the nozzle state detecting apparatus according to the aspect of the invention, when detecting the states of the nozzles, the voltage signal output units may generate the voltage signals having a voltage level which does not cause the fluids to be ejected from the nozzles.

According to another aspect of the invention, there is provided an image forming apparatus for ejecting a fluid onto a medium to form an image thereon, including an ejecting head having a plurality of nozzles and a plurality of piezoelectric elements associated therewith to eject fluids from the nozzles by respectively driving the piezoelectric elements, and the nozzle state detecting apparatus according to the first aspect of the invention.

Since the image forming apparatus according to the aspect of the invention includes the nozzle state detecting apparatus according to the first aspect, the image forming apparatus has an advantage of the nozzle state detecting apparatus detecting the states of a plurality of nozzles simultaneously, and thus ensuring complete detection of the nozzle states quickly, and an advantage of suppressing heat generated in the operation as compared with the type that has a single second switch and a single voltage waveform detecting unit provided for a plurality of piezoelectric elements and detects the voltage waveform of the piezoelectric elements to be driven while switching from one piezoelectric element to be driven to another.

The image forming apparatus according to the second aspect of the invention may further include a carriage having the ejecting head mounted thereon in a main scanning direction, and a moving unit that moves the carriage, wherein the second switches and the voltage waveform detecting units are mounted on the carriage. A nozzle state detecting apparatus of a type that detects a change in capacitance involves a minute voltage waveform and is thus susceptible to the influence of noise. However, mounting the voltage waveform detecting units on the carriage can minimize the influence of noise, ensuring high detection accuracy.

The image forming apparatus according to the second aspect of the invention may further include a capping device that seals the ejecting head in standby mode, wherein the states of the nozzles are detected while the ejecting head is sealed. This permits the states of the nozzles to be detected by effectively using the standby time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
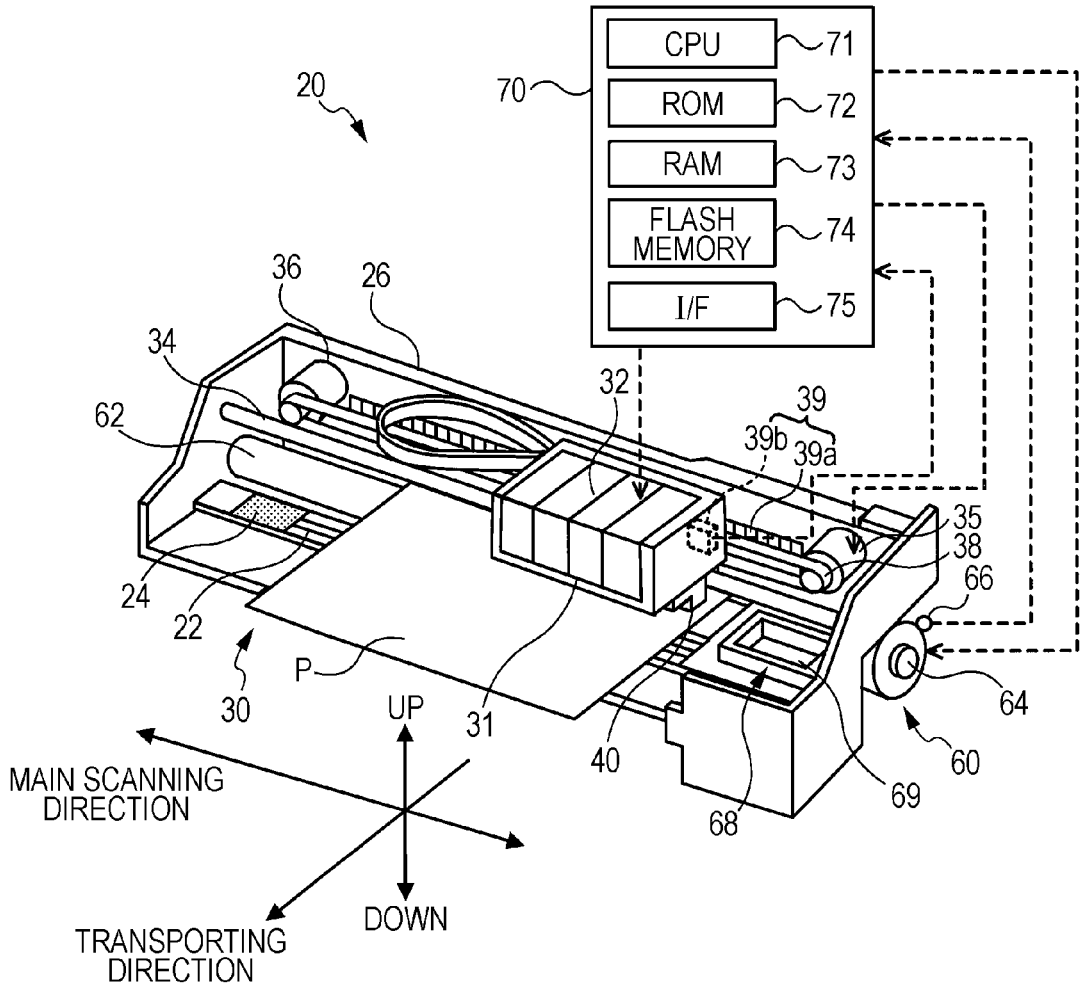
FIG. 1 is a schematic configurational diagram of an ink jet printer according to an exemplary embodiment of the invention.

Exemplary embodiments of the invention will be described below with reference to the accompanying drawings. FIG. 1 is a configurational diagram schematically illustrating the configuration of an ink jet printer 20 according to an exemplary embodiment of the invention, FIG. is a configurational diagram schematically illustrating the configuration of a printing head 40, FIG. 3 is a configurational diagram schematically illustrating the configuration of a drive circuit that drives the printing head 40, and FIG. 4 is a configurational diagram schematically illustrating the configuration of a mask circuit 52.

As illustrated in FIG. 1, the ink jet printer 20 according to the exemplary embodiment of the invention includes a sheet transporting mechanism 60 that transports a recording sheet P in a sub-scanning direction (direction frontward from the depth side in FIG. 1), a printer mechanism 30 that ejects ink droplets on the recording sheet P transported on a platen 22 by the sheet transporting mechanism 60 from nozzles formed on the printing head 40 to effect printing while moving in a main scanning direction (sideward in FIG. 1) with respect to the recording sheet P, and a controller 70 that performs the general control of the ink jet printer 20. A capping device 68 that seals the nozzle surfaces of the printing head 40 is disposed at one end of the platen 22 in the main scanning direction (right-hand end in FIG. 1). A flushing area 24 for regularly flushing out ink droplets from the nozzles of the printing head 40 is provided at the other end of the platen 22 in the main scanning direction (left-hand end in FIG. 1) to prevent clogging of the nozzles.

As illustrated in FIG. 1, the printer mechanism 30 includes a carriage 31 capable of reciprocally moving in the main scanning direction while being guided by a carriage guide 34, a carriage motor 35 disposed at one end of the carriage guide 34, a driven roller 36 disposed at the other end of the carriage guide 34, a carriage belt 38 put around the carriage motor 35 and the driven roller 36 and attached to the carriage 31, ink cartridges 32 mounted on the carriage 31 and containing inks of individual colors, cyan (C), magenta (M), yellow (Y) and black (K), and the printing head 40 on which a plurality of nozzles 41 are formed to eject ink droplets therefrom by applying pressure to the individual inks supplied from the respective ink cartridges 32. The carriage 31 reciprocally moves in the main scanning direction when the carriage belt 38 is driven by the carriage motor 35. A carriage position sensor 39 that detects the position of the carriage 31 in the main scanning direction is mounted on the rear side of the carriage 31. The carriage position sensor 39 includes a linear optical scale 39*a* disposed on a flame 26 along the carriage guide 34, and an optical sensor 39*b* mounted on the back of the carriage 31 so as to face the optical scale 39*a* and optically read the optical scale 39*a*.

Figure 2:
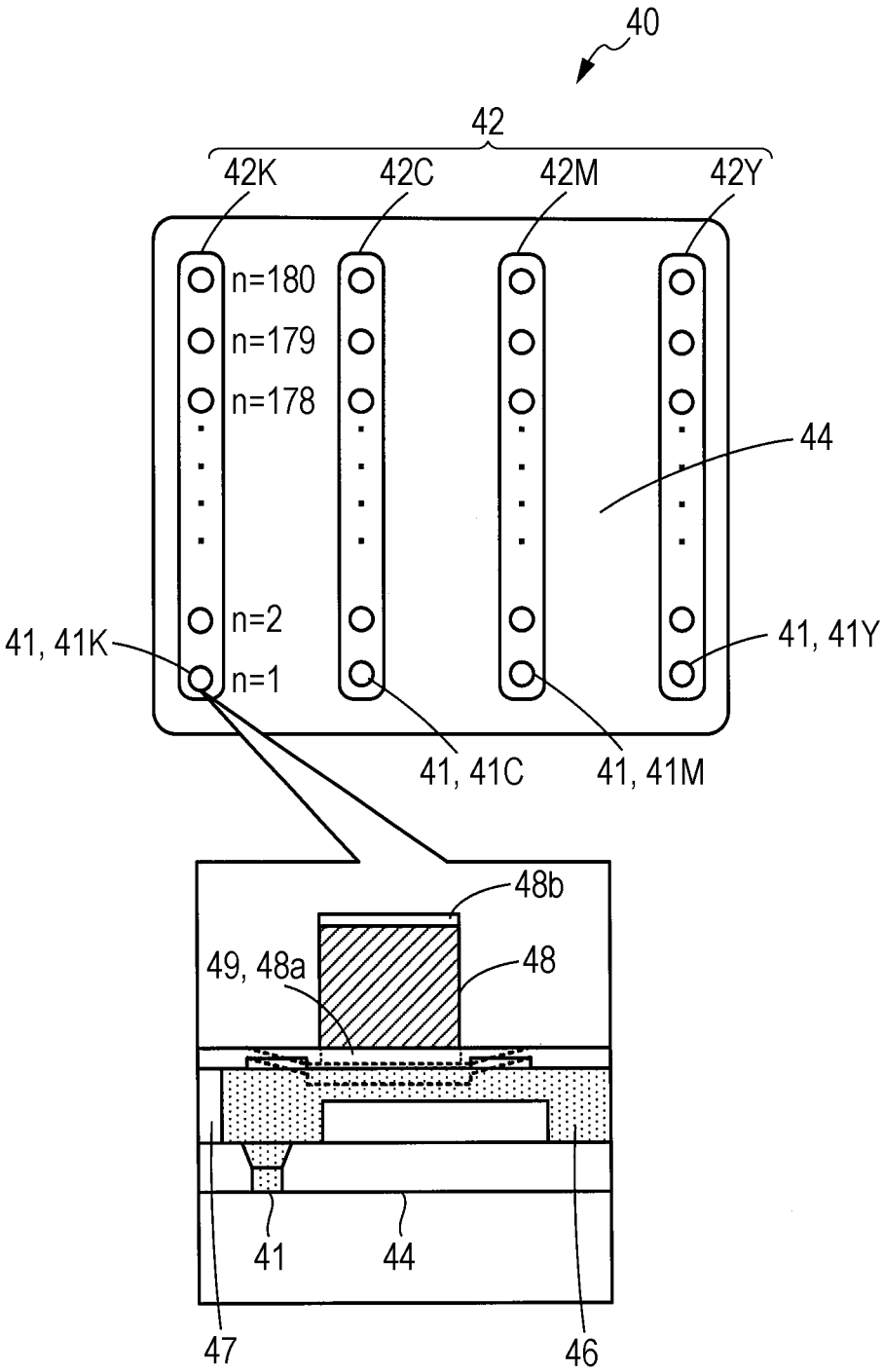
FIG. 2 is a schematic configurational diagram of a printing head.
Figure 3:
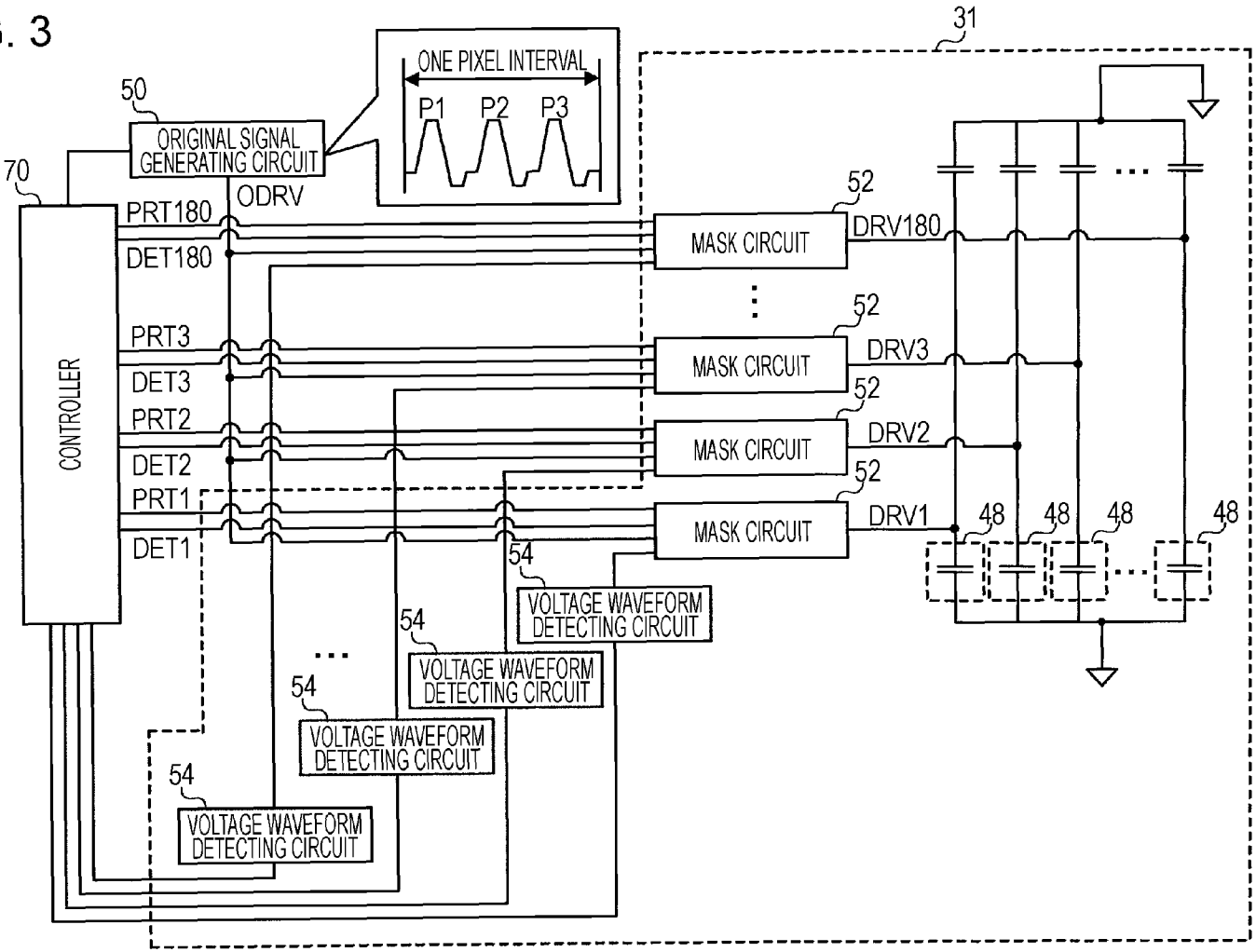
FIG. 3 is a schematic configurational diagram of a drive circuit that drives the printing head.
Figure 4:
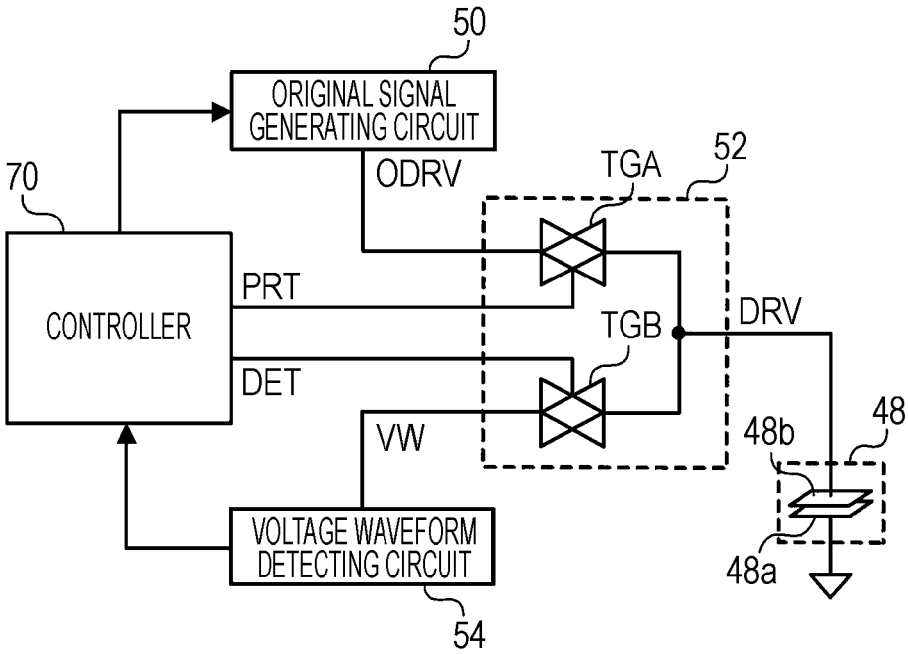
FIG. 4 is a schematic configurational diagram of a mask circuit.

As illustrated in FIGS. 2 and 3, the printing head 40 includes a nozzle plate 44 on which four nozzle lines 42C, 42M, 42Y and 42K of cyan (C), magenta (M), yellow (Y) and black (K) each including a plurality of nozzles 41 (180 nozzles in the exemplary embodiment) are formed, a cavity plate 47 serving as a side wall to form ink chambers 46 which communicate with the nozzles 41, piezoelectric elements 48 each having an electrode 48*a* grounded and a piezoelectric substance held between the electrode 48*a* and another electrode 48*b*, elastically deformable vibrating plates 49 each serving as the electrode 48*a* of the corresponding piezoelectric element 48 to form the top wall of the ink chamber 46, and mask circuits 52 each serving as a drive circuit to apply a drive signal (voltage) to the electrode 48*b* of the corresponding piezoelectric element 48. When the mask circuit 52 applies a pulse voltage to the piezoelectric element 48, the top wall (vibrating plate 49) of the ink chamber 46 is vibrated to change the inner volume of the ink chamber 46. When the contraction pressure that is generated upon contraction of the volume of the ink chamber 46 is applied, the printing head 40 ejects the corresponding ink as ink droplets from the nozzles 41 communicating with the ink chamber 46. Since the piezoelectric element 48 has a piezoelectric substance sandwiched between the two electrodes 48*a*, 48*b*, it can be regarded as a capacitor. All of the nozzles 41C, 41M, 41Y, 41K will be generally called "nozzles 41" hereinafter, and all of the nozzle lines 42C, 42M, 42Y, 42K will be generally called "nozzle lines 42" hereinafter. Driving of the printing head 40 will be explained referring to the nozzles 41K for black (K).

As illustrated in FIG. 3, the mask circuits 52 are mounted on the carriage 31, receive original signals ODRV and print signals PRTn generated by an original signal generating circuit 50, generate drive signals DRVn based on the received original signals ODRV and print signals PRTn, and output the drive signals DRVn to the corresponding piezoelectric elements 48. Note that the letter "n" affixed to the ends of the print signal PRTn and the drive signal DRVn is a number specifying a nozzle included in each nozzle line, and n is any integer from "1" to "180", because each nozzle line contains 180 nozzles according to the exemplary embodiment. The original signal generating circuit 50 sends the mask circuit 52 a signal containing three pulses, namely, a first pulse P1, second pulse P2 and third pulse P3, as a repetitive unit in one pixel interval (a time during which the carriage 31 moves across one pixel interval) as the original signal ODRV. The mask circuit 52 which has received the original signal ODRV masks an unnecessary pulse in the three pulses included in the original signal ODRV based on the print signal PRTn input separately, thereby outputting only a necessary pulse as the drive signal DRVn to the piezoelectric elements 48 of the nozzles 41K. When only the first pulse P1 is output to the piezoelectric elements 48 as the drive signal DRVn at this time, one shot of ink droplets is ejected from the nozzles 41K to form dots of a small size (small dots) on the recording sheet P. When the first pulse P1 and the second pulse P2 are output to the piezoelectric elements 48, two shots of ink droplets are ejected from the nozzles 41K to form dots of an intermediate size (intermediate dots) on the recording sheet P. When the first pulse P1, the second pulse P2 and the third pulse P3 are output to the piezoelectric elements 48, three shots of ink droplets are ejected from the nozzles 41K to form dots of a large size (large dots) on the recording sheet P. In this manner, the ink jet printer 20 can form dots of three sizes by adjusting the amount of ink to be ejected in one pixel interval. The same descriptions on the nozzle 41K and the nozzle line 42K are applied to the other nozzles 41C, 41M, 41Y, and the nozzle lines 42C, 42M, 42Y respectively.

As illustrated in FIG. 4, the mask circuit 52 includes two transmission gates TGA and TGB. The transmission gate TGA has a control terminal connected to an output port of the controller 70, an input terminal connected to the output terminal of the original signal generating circuit 50, and an output terminal connected to the electrode 48*b* of the corresponding piezoelectric element 48. When an ON signal is input to the control terminal of the transmission gate TGA from the controller 70, the transmission gate TGA electrically connects mutually the input and output terminals thereof to transfer the drive signal to the electrode 48*b* of the piezoelectric element 48 from the original signal generating circuit 50. When an OFF signal is input to the control terminal of the transmission gate TGA from the controller 70, the transmission gate TGA electrically disconnects the input and output terminals from each other to block the transfer of the drive signal to the electrode 48*b* of the piezoelectric element 48 from the original signal generating circuit 50. The transmission gate TGB has a control terminal connected to another output port of the controller 70, an input terminal connected to the electrode 48*b* of the corresponding piezoelectric element 48, and an output terminal connected to the input terminal of the corresponding voltage waveform detecting circuit 54. When an ON signal is input to the control terminal of the transmission gate TGB from the controller 70, the transmission gate TGB electrically connects mutually the input and output terminals thereof to transfer the drive signal to the voltage waveform detecting circuit 54 from the electrode 48*b* of the piezoelectric element 48. When an OFF signal is input to the control terminal of the transmission gate TGB from the controller 70, the transmission gate TGB electrically disconnects the input and output terminals from each other to block the transfer of the drive signal to the voltage waveform detecting circuit 54 from the electrode 48*b* of the piezoelectric element 48.

The piezoelectric element 48 (vibrating plate 49), the mask circuit 52 and the voltage waveform detecting circuit 54 are provided for each of the nozzles 41 as illustrated in FIGS. 2 and 3. When the piezoelectric element 48 (vibrating plate 49) is driven by the mask circuit 52, ink droplets are ejected from the corresponding nozzle 41, and the voltage waveform detecting circuit 54 detects a voltage waveform acting on the electrode 48*b* of the corresponding piezoelectric element 48.

The voltage waveform detecting circuit 54 detects the voltage waveform of the piezoelectric element 48 (electrode 48*b*) to detect residual vibration of the vibrating plate 49. Though not illustrated, the voltage waveform detecting circuit 54 may include, for example, an oscillation circuit, such as an RC oscillation circuit or LC oscillation circuit, which uses the capacitance of the piezoelectric element 48 (capacitor) as a C component, and a counter which counts the number of pulses in an oscillation signal from the oscillation circuit. When the piezoelectric element 48 is driven, the vibrating plate 49 starts vibrating, and the vibration continues (residual vibration) while being attenuated. At this time, if ink near the nozzle 41 dries and adheres or increases its viscosity, the attenuation of the vibration of the vibrating plate 49 becomes faster (over-attenuated), shortening the period of residual vibration. Therefore, an ejection failure of a nozzle 41 can be determined by detecting the period of residual vibration of the vibrating plate 49. According to the exemplary embodiment, the voltage waveform detecting circuits 54 are mounted together with the mask circuits 52 on the carriage 31. This is premised on that the detection result is susceptible to noise such that the voltage level of the piezoelectric element 48 (electrode 48*b*) to be detected is reduced by the parasitic capacitance from another piezoelectric element 48 in the circuit 54, or noise is superimposed on the detection result upon reception of transmitted attenuating vibration of another piezoelectric element 48.

The sheet transporting mechanism 60, as illustrated in FIG. 1, includes a transporting roller 62 that transports the recording sheet P onto the platen 22, and a transporting motor 64 that rotates the transporting roller 62. The transporting motor 64 has a rotating shaft mounted with a rotary encoder 66 that detects the amount of rotation thereof. The rotation of the transporting motor 64 is controlled based on the amount of rotation given from the rotary encoder 66. The rotary encoder 66 includes, though not illustrated, a rotary scale graduated at certain rotational angular intervals, and a rotary scale sensor to read the graduations on the rotary scale.

The capping device 68 seals the nozzle surfaces with the printing head 40 moved to a position facing the capping device 68 (called "home position") to prevent inks in the nozzles from drying, or sucks inks in the nozzles with the nozzle surfaces sealed to clean the printing head 40. The capping device 68 has a substantially rectangular parallelepiped cap 69 with an open top in order to seal the nozzle surfaces of the printing head 40, a tube (not illustrated) connected to the bottom of the cap 69, and a suction pump (not illustrated) attached to the tube. In cleaning the printing head 40, the capping device 68 drives the suction pump with the nozzle surfaces of the printing head 40 sealed with the cap 69, rendering the inner space formed by the nozzle surfaces of the printing head 40 and the cap 69 to negative pressure to forcibly suck the inks in the nozzles.

The controller 70 is configured as a microprocessor including a CPU 71 as the central unit, and includes a ROM 72 storing a processing program, a RAM 73 which temporarily stores data, a flash memory 74 which is rewritable and is capable of retaining data even when powered off, and an interface (I/F) 75. Data on the position of the carriage 31 from the carriage position sensor 39, the amount of rotation of the transporting roller 62 from the rotary encoder 66, etc. is input to the controller 70 via the I/F 75. The controller 70 outputs the drive signal to the printing head 40, the drive signal to the transporting motor 64, the drive signal to the carriage motor 35, the drive signal to the suction pump, etc. via the I/F 75. The controller 70 also receives a print command and print data from a user computer (PC) (not illustrated) via the I/F 75. The RAM 73 is provided with a print buffer area where received print data is stored upon reception of the print data from the user PC.

Figure 5:
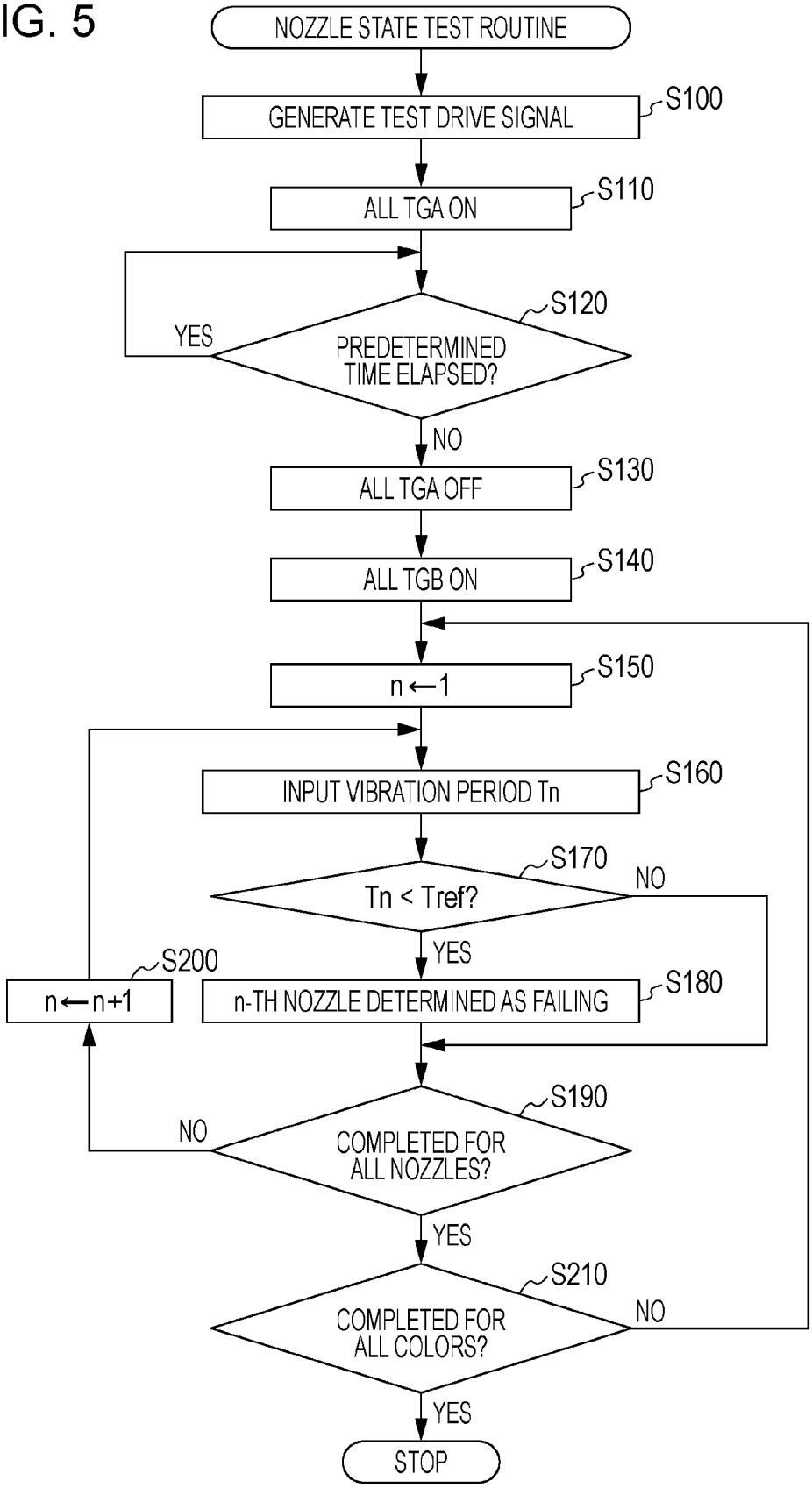
FIG. 5 is a flowchart illustrating one example of a nozzle state test routine.

Next, a description will be given of the operation of the ink jet printer 20 according to the exemplary embodiment of the invention configured in the foregoing manner, particularly, of the operation at the time of detecting an ejection failure of a nozzle 41. FIG. 5 is a flowchart illustrating one example of a nozzle state test routine that is executed by the controller 70. This routine is executed while, for example, the printing head 40 is sealed by the capping device 68 when powered on.

When the nozzle state test routine is executed, the CPU 71 of the controller 70 first instructs the original signal generating circuit 50 to generate a test drive signal (step S100). According to the exemplary embodiment, the test drive signal is a given generated voltage having a voltage level as high as possible within a range where ink droplets are not ejected from the nozzles 41. Subsequently, the CPU 71 turns on the transmission gates TGA of all the mask circuits 52, and stands by until a predetermined time passes (steps S110, S120). When the predetermined time passes, the CPU 71 turns off the transmission gates TGA of all the mask circuits 52 (step S130), and turns on the transmission gates TGB of all the mask circuits 52 (step S140). The ON/OFF switching of the transmission gates TGA causes a pulse voltage with a sharp fall to act on the piezoelectric elements 48, so that the vibrating plates 49 vibrate with attenuation. Because the transmission gates TGB have been turned on at this time, a vibration period Tn of the voltage generated on the electrode 48*b* of the piezoelectric element 48 (capacitor) due to the vibration of the vibrating plates 49 is detected by the corresponding voltage waveform detecting circuit 54 for each piezoelectric element 48. Subsequently, the nozzle number n is initialized to "0" (step S150), and the vibration period Tn of the voltage acting on the piezoelectric element 48 (electrode 48*b*) corresponding to the nozzle 41 with the nozzle number n is input from the corresponding voltage waveform detecting circuit 54 (step S160). The input vibration period Tn is compared with a threshold value Tref (step S170). The threshold value Tref is a threshold to determine whether ink droplets are properly ejected from the nozzle 41, and may be determined empirically beforehand. When the vibration period Tn is equal to or greater than the threshold value Tref, it is determined that the n-th nozzle does not have an ejection failure. When the vibration period Tn is less than the threshold value Tref, on the other hand, it is determined that the n-th nozzle has an ejection failure (step S180). Then, the CPU 71 determines whether the decision on failure is completed for all the nozzles (whether n is "180" because there are 180 nozzles 41 for each color according to the exemplary embodiment) (step S190). When it is determined that the decision on failure is not completed for all the nozzles, the nozzle number n is incremented by "1" (step S200), and the CPU 71 returns to step S160 to repeat the processes of steps S150 to S200 to determine an ejection failure on a next nozzle 41. When it is determined that the decision on failure is completed for all the nozzles, the CPU 71 determines whether the decision on failure is completed for all the colors (step S210). When it is determined that the decision on failure is not completed for all the colors, the CPU 71 returns to step S150 to repeat the processes of steps S150 to S190 to determine an ejection failure on a next color. When it is determined that the decision on failure is completed for all the colors, the CPU 71 terminates the routine. According to the exemplary embodiment, the transmission gates TGB in the mask circuits 52 and the voltage waveform detecting circuits 54 equal in number to the nozzles 41 (piezoelectric elements 48) are provided, so that the test can be carried out on all the nozzles 41 at the same time, thus completing the nozzle test quickly.

When any of the nozzles 41 formed on the printing head 40 is determined as having an ejection failure, the driving of the carriage motor 35 is controlled so as to move the printing head 40 to a position where the nozzle surfaces face the flushing area 24 and flushing is carried out to eject ink droplets from the nozzle 41 that is determined as having an ejection failure toward the flushing area 24. When flushing is carried out, the test on an ejection failure on the nozzle 41 as illustrated in FIG. 5 is performed again. When the nozzle 41 is restored to the proper state as a result of the re-testing, the test is terminated. When the nozzle 41 is not restored to the proper state, however, a cleaning process is carried out to seal the printing head 40 with the capping device 68, and drive the pump (not illustrated) to set the sealed interior to negative pressure to thereby forcibly suck the ink in the nozzle 41.

The correlation between the components of the exemplary embodiment and the components of the invention is illustrated. The printing head 40 according to the exemplary embodiment corresponds to the "ejecting head", the piezoelectric element 48 corresponds to the "piezoelectric element", the original signal generating circuit 50 corresponds to the "voltage signal output unit", the transmission gate TGA corresponds to the "first switch", the transmission gate TGB corresponds to the "second switch", the voltage waveform detecting circuit 54 corresponds to the "voltage waveform detecting unit", and the controller 70 corresponds to the "nozzle state determining unit". Further, the carriage 31 corresponds to the "carriage", and the carriage guide 34, the carriage motor 35, the driven roller 36 and the carriage belt 38 correspond to the "moving unit".

According to the foregoing ink jet printer 20 of the exemplary embodiment, the transmission gate TGB is provided in the mask circuit 52 having the transmission gate TGA which transfers or blocks the voltage signal from the original signal generating circuit 50 to the piezoelectric element 48 (electrode 48*b*), and the voltage waveform detecting circuit 54 is connected to the electrode 48*b* of the corresponding piezoelectric element 48 via the transmission gate TGB. The transmission gates TGB and the voltage waveform detecting circuit 54 are provided exclusively for each piezoelectric element. In detecting an ejection failure of each nozzle 41, the original signal generating circuit 50 generates a test drive signal to switch all the transmission gates TGA on for a certain time, and then switch them off, and switch all the transmission gates TGB on, so that the period of the voltage waveform generated by attenuating vibration (residual vibration) of the vibrating plate 49 is detected by the voltage waveform detecting circuit 54 to determine an ejection failure of the corresponding nozzle. This makes it possible to carry out detection of an ejection failure on all the nozzles 41 at the same time, thus completing the test quickly. Therefore, a process for dealing with an ejection failure, such as flushing or cleaning, can be carried out promptly. Further, because the test on an ejection failure of the nozzles 41 is carried out while the printing head 40 is sealed with the capping device 68, the standby time can be used effectively, thus improving the printing throughput as compared with the type which conducts the test during printing. Because the dedicated transmission gate TGB and the dedicated voltage waveform detecting circuit 54 are provided for each piezoelectric element 48, the size of the elements can be made small to suppress the heat generation as compared with an ink jet printer of the type that has a single second switch and a single voltage waveform detecting unit provided for all the piezoelectric elements 48 and detects the voltage waveform of the piezoelectric element to be driven using the voltage waveform detecting circuit while switching from one piezoelectric element to be driven to another.

Because the voltage waveform detecting circuits 54 are mounted together with the mask circuits 52 on the carriage 31 in the ink jet printer 20 according to the exemplary embodiment, even when a voltage waveform generated by attenuating vibration (residual vibration) of the vibrating plate 49 is minute and is susceptible to the influence of noise, such a voltage waveform can be detected accurately.

Although the voltage waveform detecting circuits 54 are mounted on the carriage 31 in the ink jet printer 20 according to the exemplary embodiment, the voltage waveform detecting circuits 54 may be mounted on the frame 26, not on the carriage 31, though the voltage waveform detecting circuits 54 are susceptible to the influence of noise.

Although the test on an ejection failure of the nozzles 41 is carried out while the printing head 40 is sealed with the capping device 68 when powered on, the invention is not limited to this case, and the test on an ejection failure of the nozzles 41 may be carried out upon reception of a print command before starting printing, or the test on an ejection failure of the nozzles 41 may be carried out during printing. In the latter case, the transmission gate TGB should be set on during a period from the point of time when the pulse signal (drive signal DRVn) is applied to a piezoelectric element 48 based on the print signal PRTn to the point of time when a next pulse signal is applied to that piezoelectric element 48, and residual vibration of the vibrating plate 49 should be detected by the corresponding voltage waveform detecting circuit 54.

Although the image forming apparatus according to the invention is adapted to the ink jet printer 20 according to the exemplary embodiment, the image forming apparatus may be adapted to any image forming apparatus capable of forming an image on a medium, such as a multifunction printer which is equipped with a scanner or the like in addition to a printer, or a facsimile apparatus. In addition, the image forming apparatus according to the exemplary embodiment may take the form of a nozzle state detecting apparatus which detects the states of nozzles.

It is to be noted that the invention is not limited to the foregoing exemplary embodiment, and may be worked out in various forms within the technical scope and spirit of the invention.

What is claimed is:

1. A nozzle state detecting apparatus for detecting states of a plurality of nozzles included in an ejecting head ejecting fluids from the nozzles by respectively driving a plurality of piezoelectric elements provided in the ejecting head and corresponding to the nozzles, the nozzle state detecting apparatus comprising:

a voltage signal output unit that outputs a voltage signal for driving the piezoelectric elements;

a plurality of first switches provided in association with the piezoelectric elements, and having input terminals connected to the voltage signal output unit and output terminals connected to electrodes of the respective piezoelectric elements to effect connection and disconnection between the input and output terminals;

a plurality of second switches provided in association with the piezoelectric elements, and having input terminals connected to the electrodes of the respective piezoelectric elements to effect connection and disconnection between the input and output terminals;

a plurality of voltage waveform detecting units provided in association with the piezoelectric elements and connected to the output terminals of the second switches to detect voltage waveforms of the respective piezoelectric elements via the second switches; and a nozzle state determining unit that, when detecting the states of the nozzles, controls the first switches and the second switches to set the first switches off and set the second switches on, and determines the states of the nozzles based on the respective voltage waveforms detected by the voltage waveform detecting units under the switch control.

2. The nozzle state detecting apparatus according to claim 1, wherein when detecting the states of the nozzles, the voltage signal output units generate the voltage signals having a voltage level which does not cause the fluids to be ejected from the nozzles.

3. An image forming apparatus for ejecting a fluid onto a medium to form an image thereon, comprising:

an ejecting head having a plurality of nozzles and a plurality of piezoelectric elements associated therewith to eject fluids from the nozzles by respectively driving the piezoelectric elements; and the nozzle state detecting apparatus as set forth in claim 2.

4. The image forming apparatus according to claim 3, further comprising:

a carriage having the ejecting head mounted thereon in a main scanning direction; and a moving unit that moves the carriage, wherein the second switches and the voltage waveform detecting units are mounted on the carriage.

5. The image forming apparatus according to claim 3, further comprising:

a capping device that seals the ejecting head in standby mode, wherein the states of the nozzles are detected while the ejecting head is sealed.

6. The image forming apparatus according to claim 4, further comprising:

a capping device that seals the ejecting head in standby mode, wherein the states of the nozzles are detected while the ejecting head is sealed.

7. An image forming apparatus for ejecting a fluid onto a medium to form an image thereon, comprising:

an ejecting head having a plurality of nozzles and a plurality of piezoelectric elements associated therewith to eject fluids from the nozzles by respectively driving the piezoelectric elements; and the nozzle state detecting apparatus as set forth in claim 1.

8. The image forming apparatus according to claim 7, further comprising:

a carriage having the ejecting head mounted thereon in a main scanning direction; and a moving unit that moves the carriage, wherein the second switches and the voltage waveform detecting units are mounted on the carriage.

9. The image forming apparatus according to claim 7, further comprising:

a capping device that seals the ejecting head in standby mode, wherein the states of the nozzles are detected while the ejecting head is sealed.

10. The image forming apparatus according to claim 8, further comprising:

a capping device that seals the ejecting head in standby mode, wherein the states of the nozzles are detected while the ejecting head is sealed.

* * * * *